US012643583B2

(12) United States Patent
Fries et al.

(10) Patent No.: US 12,643,583 B2
(45) Date of Patent: Jun. 2, 2026

(54) RAILWAY DETECTION SYSTEM, RAILWAY INFRASTRUCTURE AND METHOD FOR DETECTING THE PRESENCE OF A RAILWAY VEHICLE

(71) Applicant: KB Signaling Inc., West Henrietta, NY (US)

(72) Inventors: Jeffrey Fries, Grain Valley, MO (US); John Ross, West Melbourne, FL (US)

( * ) Notice: Subject to any disclaimer, the term of this patent is extended or adjusted under 35 U.S.C. 154(b) by 855 days.

(21) Appl. No.: 18/052,829

(22) Filed: Nov. 4, 2022

(65) Prior Publication Data

US 2024/0149931 A1 May 9, 2024

(51) Int. Cl.

| | |
|---|---|
| ***B61L 1/18*** | (2006.01) |
| ***B61L 3/22*** | (2006.01) |
| ***B61L 7/08*** | (2006.01) |
| ***B61L 13/04*** | (2006.01) |
| ***B61L 25/02*** | (2006.01) |
| ***B61L 27/70*** | (2022.01) |
| ***B61L 29/22*** | (2006.01) |

(52) U.S. Cl.

CPC ..... *B61L 1/182* (2013.01); *B61L 1/185* (2013.01); *B61L 1/187* (2013.01); *B61L 1/188* (2013.01); *B61L 3/221* (2013.01); *B61L 7/08* (2013.01); *B61L 13/042* (2013.01); *B61L 25/021* (2013.01); *B61L 25/025* (2013.01); *B61L 27/70* (2022.01); *B61L 29/226* (2013.01)

(58) Field of Classification Search

CPC ..... B61L 1/182; B61L 1/185; B61L 1/187; B61L 1/188; B61L 3/221; B61L 7/08; B61L 13/042; B61L 25/021; B61L 25/025; B61L 27/70; B61L 29/226; B61L 23/044; B61L 1/20

USPC ..... 246/122 R, 34 R

See application file for complete search history.

(56) References Cited

U.S. PATENT DOCUMENTS

2008/0142645 A1* 6/2008 Tomlinson ..... B61L 1/181 246/122 R

2021/0139059 A1* 5/2021 Schmidt ..... B61L 1/188

FOREIGN PATENT DOCUMENTS

GB 2400222 A 10/2004

* cited by examiner

*Primary Examiner* — Zachary L Kuhfuss

(74) *Attorney, Agent, or Firm* — David L. Nocilly; Bond Schoeneck & King PLLC

(57) ABSTRACT

Railway detection system for detecting the presence of a railway vehicle on a railway track section comprising at least two rails, the railway track section comprising a first end and a second end opposite to the first end in a longitudinal direction of the railway track section, the railway detection system comprising a track circuit system comprising a signal generator electrically coupled to the first end of the railway track section, the signal generator being configured for generating a first track circuit signal to be injected into the railway track section at the first end, wherein the signal generator is adapted to generate a first component of the first track circuit signal comprising at least one DC pulse;

generate a second component of the first track circuit signal, and add the first and the second component so as to obtain the first track circuit signal.

20 Claims, 7 Drawing Sheets

RAILWAY DETECTION SYSTEM, RAILWAY INFRASTRUCTURE AND METHOD FOR DETECTING THE PRESENCE OF A RAILWAY VEHICLE

FIELD OF THE INVENTION

The present invention concerns a railway detection system for detecting the presence of a railway vehicle.

The present invention also relates to a railway infrastructure comprising such railway detection system.

The present invention furthermore relates to a method for detecting the presence of a railway vehicle.

BACKGROUND OF THE INVENTION

In order to detect railway vehicles in a section of a railway track, a railway infrastructure may comprise for example track circuit equipment. Such track circuit equipment uses a transmitter to apply a current to rails of the railway track section. If no railway vehicle is present in the railway section, a receiver, installed at the railway infrastructure in a distance from to the transmitter, allows detecting the current and thus determining that the railway track section is clear of railway vehicles.

On the contrary, if a railway vehicle is present in the railway track section, the current applied by the transmitter may flow at least partially via wheels and axles of the railway vehicle from one rail to the other. The wheels and axles present a short circuit between the rails, bypassing at least partially the receiver. Thus, the receiver does not receive the emitted current, or at least receives only a small fraction. In this way, the track circuit equipment is configured for determining that the railway track section is occupied.

If the electrical resistance between the contact of the wheels and the rails is not sufficiently low, the track circuit equipment may fail to detect a railway vehicle. In particular, in this case, the receiver may receive the current corresponding to the current applied by the transmitter, despite the presence of the railway vehicle. In this case the current may not, or only at a small fraction, bypass the receiver via the wheels and axles of the vehicle.

The electrical resistance between the wheels and the rails may for example increase due to rail or wheel surface contaminants, such as rust, leaves, brake dust or grease.

In order to reduce the chance of detection failure, additional shunt enhancer modules may be installed in the railway track section. Each shunt enhancer module is for example connected to the rails via a dedicated electrical connection, distinct electrical contacts of track circuit equipment, in order to inject a current into the rails, so as to reduce the electrical resistance of a part of the railway track section under surveillance by the track circuit equipment.

In order to reduce the electrical resistance in the whole railway track section, due to restrictions such as limited power, it is generally necessary to install a plurality of such shunt enhancers distributed along the railway track section, each having its dedicated electrical connection to the rails. For example, it is typical to install a shunt enhancer at a location of a specific piece of train detection equipment, such as a level crossing, a wayside track circuit, etc.

However, such installation is relatively complex and cost-intensive.

The document GB 2 400 222 A discloses a train detection system in which a signal is injected into rails in order to be detected by a receiver. The signal is generated by a modulator which modulates a pulse signal for example by using pulse position modulation or pulse width modulation, so as to obtain a coded signal which can be distinguished from signals of neighboring track sections.

However, the train detection system of GB 2 400 222 A does not allow to obtain shunt enhancement at all times during a detection period. Also, a high number of different signal treatment devices are required according to the system of GB 2 400 222 A.

SUMMARY OF THE INVENTION

An aim of the present disclosure is to remedy the above-mentioned drawbacks.

In particular, an object of the present disclosure is to provide a railway detection system which is particularly simple and cost efficient, and allows detecting a railway vehicle in a safe manner in each position of a railway track section.

According to one aspect, the present disclosure relates to a railway detection system for detecting the presence of a railway vehicle on a railway track section comprising at least two rails, the railway track section comprising a first end and a second end opposite to the first end in a longitudinal direction of the railway track section, the railway detection system comprising a track circuit system comprising:

- a signal generator electrically coupled to the first end of the railway track section, the signal generator being configured for generating a first track circuit signal to be injected into the railway track section at the first end, wherein the signal generator is adapted to
  - generate a first component of the first track circuit signal comprising at least one DC pulse;
  - generate a second component of the first track circuit signal, the second component comprises at least one element chosen from a constant DC signal and a constant frequency AC signal,
  - add the first and the second component so as to obtain the first track circuit signal,
- a track circuit receiver connected to the second end of the railway track section and adapted to receive the first track circuit signal injected by the signal generator into the railway track section;
- a track circuit detection device connected to the track circuit receiver, the track circuit detection device being configured for determining that the railway track section is clear of railway vehicles.

Indeed, the railway detection system is very simple and cost-efficient, because one single signal generator allows reducing the electrical resistance between the rails and wheels of the railway vehicle within the railway track section.

Further embodiments of the present disclosure may relate to one or more of the following features, which may be combined in any technical feasible combination:

- the track circuit detection device is configured for determining that the railway track section is clear of railway vehicles if a current value of the first track circuit signal received by the track circuit receiver is higher than a predetermined threshold;
- the railway protection system further comprises at least one local protection device positioned in said railway track section between the first end and the second end, the at least one local protection device providing a safety related function depending on the presence of the railway vehicle in the railway track section, the at least one local protection device comprising a local detection module configured for emitting a second track signal into at least one of the rails of the railway track section, so that the local detection module is configured for detecting the presence of the railway vehicle on each position within the railway track section;

the local protection device comprises a level crossing;

the at least one local protection device comprises warning equipment configured to emit a warning if the local detection module detects the presence of the railway vehicle in the railway track section;

the warning equipment comprises at least one element among a gate, a light signal and a bell;

the local detection module is unable to detect the railway vehicle in at least one position of the railway track section in absence of the first track circuit signal, if an electrical resistance between at least one of the at least two rails and at least one wheel of the railway vehicle is higher than a resistance threshold;

the local detection module is configured for determining a complex impedance between the at least two rails;

the local detection module is configured for estimating a speed of the railway vehicle in the railway track section in function of the complex impedance and/or for estimating a distance of the railway vehicle to the local detection module in function of the complex impedance;

the constant DC signal has a voltage of at least 3 volts;

the constant frequency AC signal has a frequency range comprised between 5 Hz and 40 Hz;

the first component comprises furthermore a data signal depending on the railway track section;

the signal generator is configured for generating the second component of the first track circuit signal only if the railway vehicle is present in the railway track section;

the track circuit detection device is configured for transmitting a first detection signal relative to the presence of the railway vehicle in the railway track section to the signal generator, the signal generator being configured for generating the second component of the first track circuit signal only upon reception of the first detection signal;

the track circuit detection device is configured for transmitting a second detection signal relative to the presence of the railway vehicle in the railway track section to a remote train control system, if a current value of the first track circuit signal received by the track circuit receiver is lower than a second predetermined threshold;

the railway track section is electrically insulated by insulating joints from neighboring sections of the rails;

the signal generator is a digital signal generator;

the track circuit detection device comprises an electrical resistance estimation module configured for comparing a current value of the first track circuit signal emitted by the signal generator with the current value of the first track circuit signal received by the track circuit receiver, so as to estimate an electrical resistance between at least one rail of said at least two rails and at least one wheel of the railway vehicle.

The invention further relates to a railway infrastructure comprising a railway track section comprising at least two rails, the railway track section comprising a first end and a second end opposite to the first end in a longitudinal direction of the railway track section, wherein the railway infrastructure comprises at least one railway detection system as described above.

The invention also relates to a method for detecting the presence of a railway vehicle on a railway track section comprising at least two rails, the railway track section comprising a first end and a second end opposite to the first end in a longitudinal direction of the railway track section, the method comprising:

generating, by a signal generator electrically coupled to the first end of the railway track section, a first track circuit signal to be injected into the railway track section at the first end, the generating comprising:

generating a first component of the first track circuit signal comprising at least one DC pulse;

generating a second component of the first track circuit signal, the second component comprises at least one element chosen from a constant DC signal and a constant frequency AC signal, adding the first and the second component so as to obtain the first track circuit signal, receiving, by a track circuit receiver connected to the second end of the railway track section, the first track circuit signal injected by the signal generator into the railway track section;

detecting, by a track circuit detection device connected to the track circuit receiver, that the railway track section is clear of railway vehicles.

BRIEF DESCRIPTION OF THE DRAWINGS

These features and advantages of the invention will be further explained in the following description, given only as a non-limiting examples, and with reference to the attached drawings, wherein.

DETAILED DESCRIPTION OF THE PREFERRED EMBODIMENTS

Figure 1:
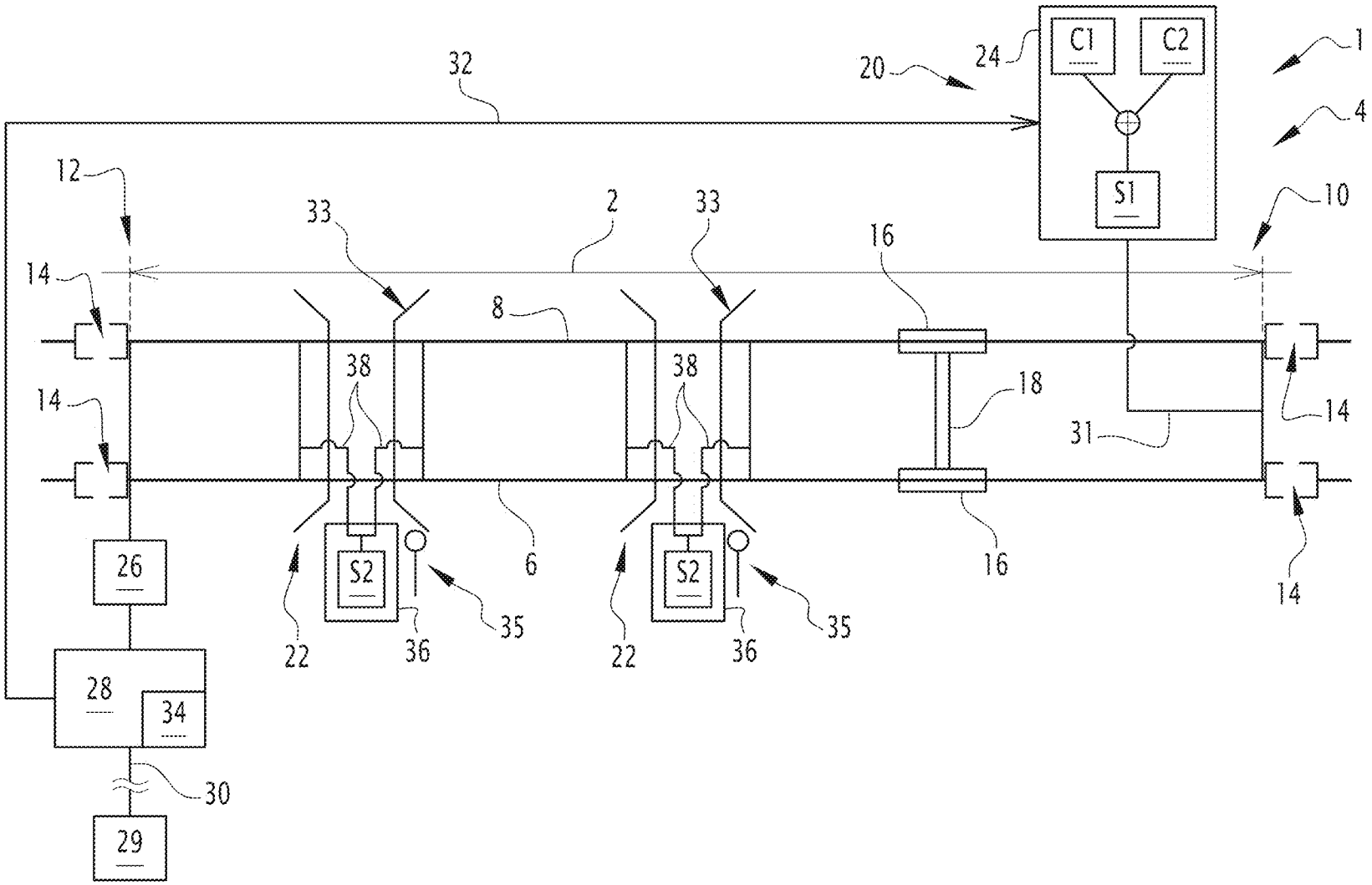
FIG. 1 is a schematic view of an example of a railway infrastructure comprising a railway detection system according to the present disclosure.

With reference to the example of FIG. 1, a railway infrastructure 1 comprises a railway track section 2 and a railway detection system 4.

The railway track section 2 comprises parallel rails 6 and 8. The railway track section 2 furthermore comprises a first end 10 and a second end 12 limiting the railway section 2. The first end 10 is opposite to the second end 12 in a longitudinal direction of the railway track section 2. The longitudinal direction is a direction parallel to the rails 6, 8. The longitudinal direction corresponds to the driving direction of a railway vehicle driving on the railway track section 2.

According to some embodiments, which may be combined with other embodiments disclosed herein, the railway track section 2 comprises joints 14 isolating electrically the railway track section 2, in particular each rail 6, 8, from neighboring sections.

A railway vehicle is adapted to circulate on the rails 6, 8 of the railway section 2. The railway vehicle comprises a plurality of wheels 16 and axles 18 electrically connecting two wheels 16.

In the example of FIG. 1, two wheels 16 and the axle 18 connecting these two wheels 16 of the railway vehicle are shown.

The wheels 16 are adapted to roll on the rails 6, 8. The wheels 16 form, in particular in the absence of rail or wheel surface contaminants, an electrical shunt between the rails 6, 8 via the axle 18. By "electrical shunt", it is understood that electrical signals are transmitted from one of the rails 6 to the other rail 8 via the wheels 16 and the axle 18.

According to embodiments, the railway detection system 4 comprises one or more local protection devices 22 providing a safety related function depending on the presence of the railway vehicle in the railway track section 2, and depending in particular on a distance of the railway vehicle to the corresponding local protection device 22. In the example of FIG. 1, the railway detection system 4 comprises two local protection devices 22. Each local protection device 22 forms for example equipment configured for allowing safe level crossing of the railway infrastructure 1 by road users.

According to embodiments, the railway detection system 4 is devoid of axle counters able to count axles of the railway vehicle in the railway track section 2.

The railway detection system 4 comprises a track circuit system 20 configured for detecting the presence of the railway vehicle on the railway track section 2.

The track circuit system 20 comprises a signal generator 24, a track circuit receiver 26 and a track circuit detection device 28 connected to the track circuit receiver 26.

According to embodiments, the track circuit system 20 comprises furthermore a train control system 29, which is remote from the track circuit detection device 28, and for example connected to via a data connection 30 to the track circuit detection device 28.

The signal generator 24 is electrically coupled to the first end 10 of the railway track section 2, for example via at least two electrical wires 31. The electrical wires 31 connect preferably the signal generator to both rails 6, 8.

According to embodiments, the signal generator 24 is housed in a single housing.

According to embodiments, the signal generator 24 has respectively one electrical connection with each rail 6, 8, in particular via the electrical wires 31. For example, the signal generator 24 is connected at one position only to rail 6 and at one position only to rail 8.

The signal generator 24 is configured for generating a first track circuit signal S1 to be injected into the railway track section 2 at the first end 10, in particular via the electrical wires 31.

The signal generator 24 is for example a digital signal generator. The signal generator 24 is in particular configured for generating the first track circuit signal S1 from binary values, and to inject the first track circuit signal S1 in the form of an electrical signal into the railway track section 2. The first track circuit signal S1 is an analog signal, in particular a continuous analog signal.

According to embodiments, the signal generator 24 comprises dedicated circuitry configured for generating the first track circuit signal S1. For example, the signal generator 24 comprises a computer having at least one memory and at least one processor configured for determining the signal S1.

The signal generator 24 is adapted to generate a first component C1 of the first track circuit signal S1, to generate a second component C2 of the first track circuit signal S1, and to add the first component C1 and the second component C2 so as to obtain the first track circuit signal S1.

By "to add", it is understood generating the sum of values corresponding to the first component C1 and the second component C2 for each time step.

According to embodiments, the signal generator 24 is configured for adding the first component C1 and the second component C2 in the digital domain, to obtain a digital signal and, in particular, to transfer this signal into the first track circuit signal S1. For example, the signal generator 24 is configured for determining, in the digital domain, the sum of a numerical value of the first component C1 and a numerical value of the second component C2 for each time step. Each numerical value comprises in particular a specific voltage.

According to other embodiments, the signal generator 24 is configured for adding the components C1, C2 in the analog domain. In this case, the signal generator 24 is configured for determining the sum of the voltages of the first and second components C1, C2.

According to embodiments, the signal generator 24 is configured for generating the first track circuit signal S1 in the absence of a multiplication or modulation of the components C1 and C2.

The electrical resistance of a shunt between the rails 6, 8 via the wheels 16 and the axle 18 of a railway vehicle is reduced, thanks to adding to the first component C1 the second component C2, even in the presence of wheel surface contaminants. The reduction is obtained whenever the second component C2 is present in the first track circuit signal S1. The electrical shunting between the rails 6, 8 is thus improved.

In particular, the second component C2 is able to enhance shunting between the rails 6, 8 and the wheels 16 of the railway vehicle, and thus to enable transmission of the track circuit signal S1 between the rails via the wheels 16 and the axles 18. For example, the second component C2 provides an electrical tension allowing the signal S1 to break through a resistance between the rails 6, 8 and the wheel 18 in contact with the corresponding rail 6, 8, for example due to surface contaminants.

According to an example, the signal generator 24 is configured for generating the second component C2 of the first track circuit signal S1 only if a railway vehicle is present in the railway track section 2.

In particular, the signal generator 24 is configured for receiving a first detection signal relative to the presence of the railway vehicle in the railway track section 2, and for generating the second component C2 of the first track circuit signal S1 only upon reception of the first detection signal. Preferably, the signal generator 24 is configured for generating a first track circuit signal S1 consisting of the first component C1 only otherwise.

For example, the signal generator 24 is configured for receiving the first detection signal from the track circuit detection device 28 via a data connection 32.

According to another example, the signal generator 24 is configured for receiving the first detection signal from additional equipment, such as additional train control equipment, not illustrated in the example of FIG. 1.

According to embodiments, the railway detection system 4 comprises, at each end 10, 12 of the railway track section 2 both the signal generator 24 and the track circuit detection device 28, for example arranged in a same housing. In this case, the railway detection system 4 is in particular configured for detecting, at each end 10, 12, if a train is present, in particular by detecting a signal from the signal generator 24 of the opposite end 10, 12. In this case, the railway detection system 4 is in particular devoid of the separate data connection 32, because the first detection signal is determined in each end 10, 12 independently from a determination at the opposite end 10, 12, in order to determine when to apply the shunt enhancing signal C2.

In the following, embodiments of the first and second components C1, C2 generated by the signal generator 24 are described.

The first component C1 comprises at least one DC pulse (from "Direct Current pulse").

According to embodiments, the first component C1 furthermore comprises additional pulses or a data signal depending on the railway track section 2. The additional pulses or data signal comprises for example a number or a code corresponding to the railway track section 2.

Figure 2:
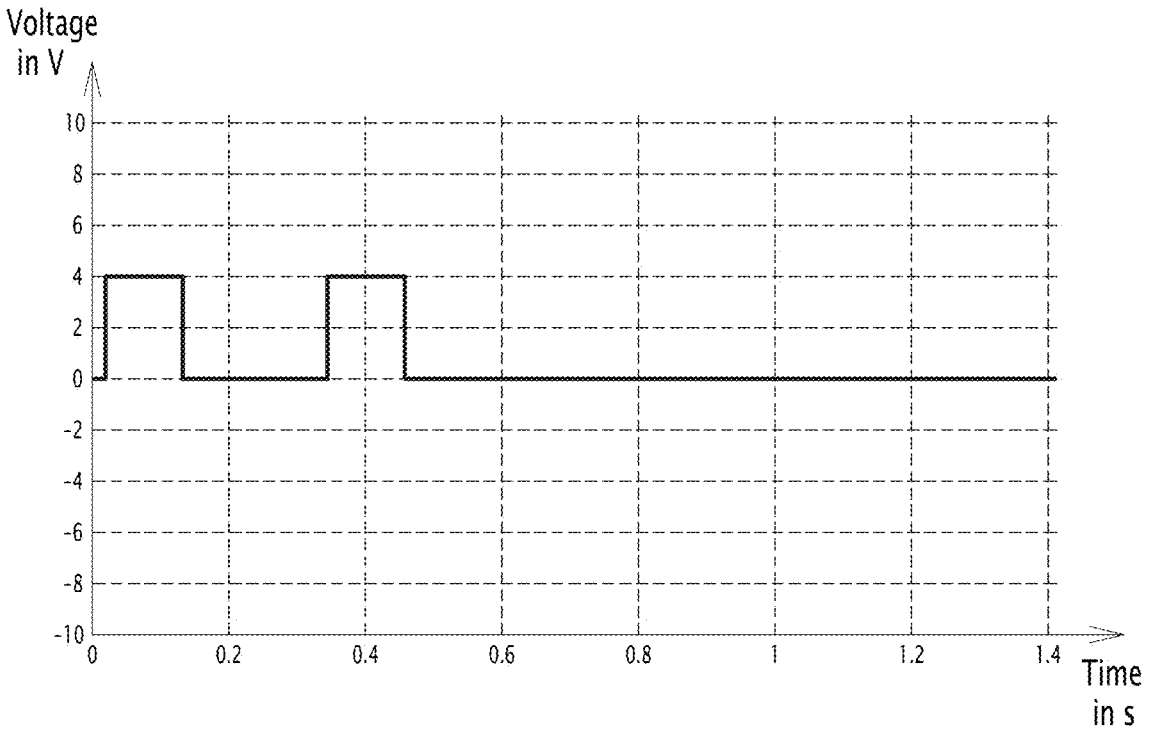
FIG. 2 is a schematic plot showing a first example of a first component of a track circuit signal generated by the railway detection system of FIG. 1.
Figure 3:
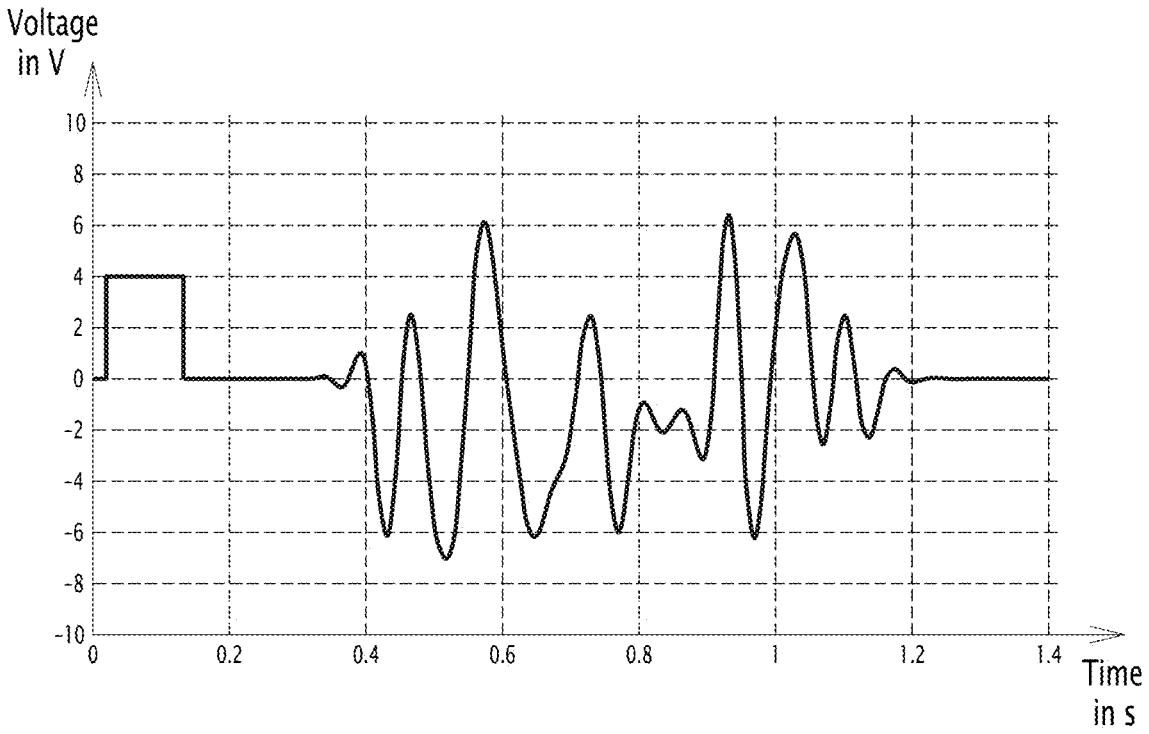
FIG. 3 is a schematic plot showing a second example of a first component of a track circuit signal generated by the railway detection system of FIG. 1.

FIGS. 2 and 3 are plots showing examples of the first component C1 of the track circuit signal S1 generated by the signal generator 24. In FIGS. 2 and 3, the voltage in volt V of the first component C1 is represented over time in seconds s.

With reference to the example of FIG. 2, the first component C1 comprises DC pulses of a voltage substantially equal to 4 V of a duration substantially equal to 0.12 s. Between the DC pulses, the first component C1 of the signal is substantially equal to 0 V, for example during 0.2 s.

With reference to the example of FIG. 3, the first component C1 comprises a DC pulse of a voltage substantially equal to 4 V and of a duration substantially equal to 0.12 s, followed by a pause having a duration substantially equal to 0.3 s, and further followed by the data signal corresponding to the railway track section 2.

According to embodiments, the DC pulses have a length of at least 0.05 s and/or less than 0.25 s, and have preferably a length substantially equal to 0.12 s.

The second component C2 comprises a constant DC signal and/or a constant frequency AC signal.

The constant DC signal of the second component C2 has for example a voltage of at least 3 volts.

The constant frequency AC signal has for example a frequency range comprised between 5 Hz and 40 Hz. The amplitude of the constant frequency AC signal is for example at least 3V.

Figure 4:
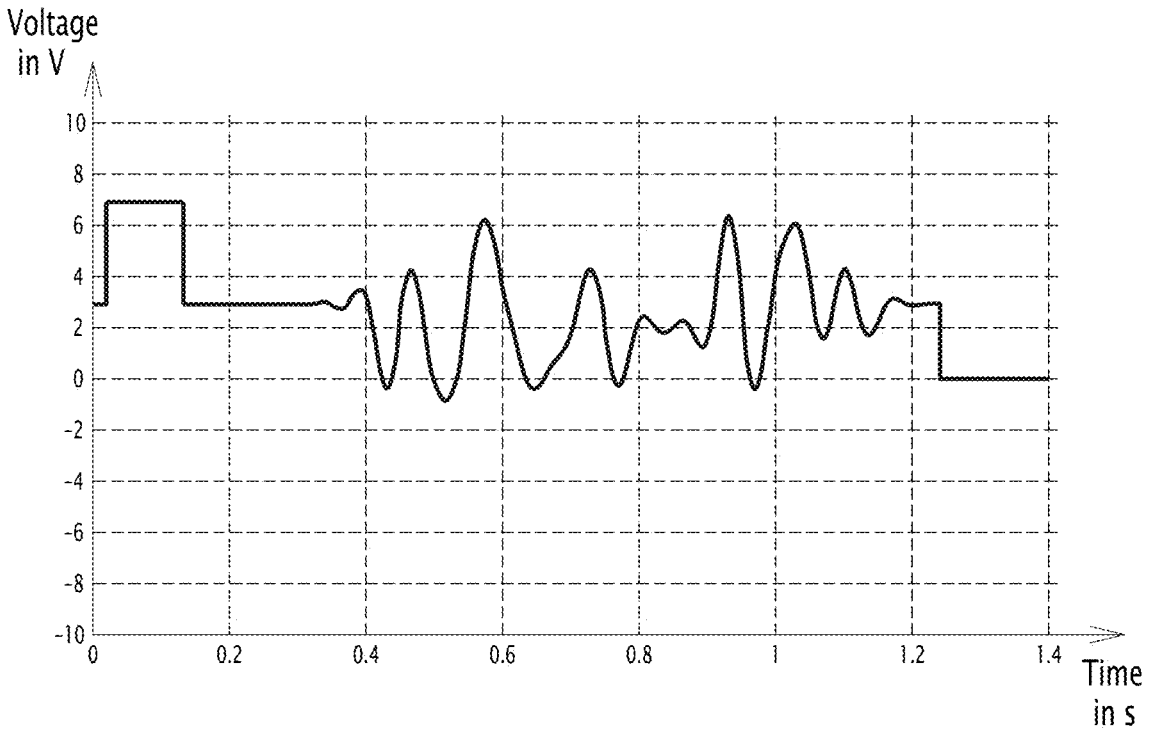
FIG. 4 is a schematic plot showing a first example of a track circuit signal generated by the railway detection system of FIG. 1, comprising the first component and a second component.
Figure 5:
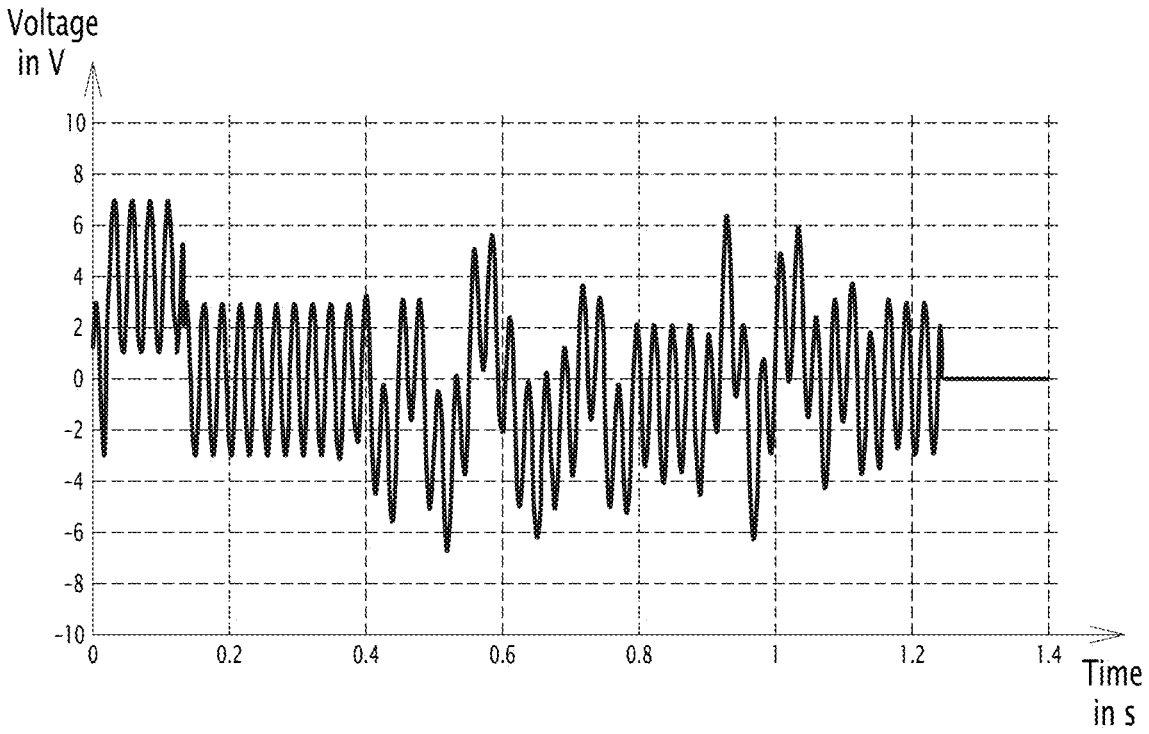
FIG. 5 is a schematic plot showing a second example of a track circuit signal generated by the railway detection system of FIG. 1, comprising the first component and a second component.

FIGS. 4 and 5 are plots showing examples of the track circuit signal S1 comprising the sum of the first component C1 and the second component C2. In FIGS. 4 and 5, examples of the voltage in volt V of the track circuit signal S1 over time in seconds s are shown.

With reference to FIG. 4, according to embodiments, the first track circuit signal S1 comprises the first component C1 of the example of FIG. 3. The second component C2 comprises a constant DC signal equal to a 3 V.

For the purpose of illustration, in FIG. 4, the voltage at t=0.2 s is equal to 3 V, corresponding to the sum of the first component C1=0 V at t=0.2 s and the second component C2=3 V constantly.

With reference to FIG. 5, according to embodiments, the first track circuit signal S1 comprises the component C1 of the example of FIG. 3. The second component C2 constant AC signal has a frequency substantially equal to 40 Hz and an amplitude of about 3V.

The track circuit receiver 26 is electrically connected at the second end 12 of the railway track section 2 to at least one of the rails 6, 8.

The track circuit receiver 26 is adapted to receive the first track circuit signal S1 injected by the signal generator 24 into the railway track section 2.

The track circuit detection device 28 is configured for determining that the railway track section 2 is clear of railway vehicles.

According to embodiments, the track circuit detection device 28 is configured for determining that the railway track section 2 is clear of railway vehicles if a current value of the first track circuit signal S1, in particular in volts or amperes, received by the track circuit receiver 26 is higher than a predetermined threshold. For example, the track circuit detection device 28 is configured to receive a measurement relative to the first track circuit signal S1 from the track circuit receiver 26 in order to determine the presence of a railway vehicle.

The predetermined threshold is for example defined in function of electrical leakage of the rails 6, 8, for example to ballast of the railway infrastructure 1, in absence of a railway vehicle in the section 2. Such electrical leakage depends for example on the length of the section 2 and/or on ballast material.

According to embodiments, the track circuit detection device 28 is configured for comparing the current value of the first track circuit signal S1 with a first predetermined threshold and with a second predetermined threshold.

The first predetermined threshold is for example different from the second predetermined threshold. For example, the first predetermined threshold is higher than the second predetermined threshold.

According to embodiments, the track circuit detection device 28 is configured for transmitting the first detection signal relative to the presence of the railway vehicle in the railway track section 2 to the signal generator 24, via the data connection 32, if the current value of the first track circuit signal S1 received by the track circuit receiver 26 is lower than the first predetermined threshold.

In embodiments according to which the signal generator 24 is configured for generating the second component C2 of the first track circuit signal S1 only upon reception of the first detection signal, the transmission depending on the current value and the first threshold allows enhancing shunting by adding the second component C2 only in case of poor shunting. The poor shunting is, in this case, detected by a small attenuation of the signal S1 so that the current value of the signal S1 received by the track circuit receiver 26 is lower than the first threshold. In another embodiment, the poor shunting may be detected by an erratic behavior of the transmitted or received signals.

According to embodiments, the track circuit detection device 28 is configured for transmitting a second detection signal relative to the presence of the railway vehicle in the railway track section 2 to the remote train control system 29, via the data connection 30, if the device 28 detects the presence of the railway vehicle in the section 2, in particular if the current value of the first track circuit signal S1 received by the track circuit receiver 26 is lower than the second predetermined threshold.

According to embodiments, the track circuit detection device 28 comprises an electrical resistance estimation module 34 configured for comparing a current value of the first track circuit signal S1 emitted by the signal generator 24 with the current value of the first track circuit signal S1 received by the track circuit receiver 26. The electrical resistance estimation module 34 is configured to estimate an electrical resistance between each rail 6, 8 and the or each wheel 16 of the railway vehicle in function of this comparison.

According to embodiments, the electrical resistance estimation module 34 comprises a model of the railway track section 2 having data relative to expected values of the first track circuit signal S1 received by the track circuit receiver 26. For example, the electrical resistance estimation module 34 is configured to compare the current value of the first track circuit signal S1 received by the track circuit receiver 26 with the corresponding value of the model, so as to detect poor shunting between the rails 6, 8 and the wheels 16.

According to embodiments, the electrical resistance estimation module 34 is configured for emitting a shunting condition signal via the data connection 32 to the signal generator 24, for example in view of an amplification of the first track circuit signal S1 in case of poor shunting.

According to embodiments, the or each local protection device 22 is positioned in the railway track section 2 between the first end 10 and the second end 12.

The local protection device 22 comprises a level crossing 33, a warning equipment 35 and local detection module 36.

The level crossing 33 is able to allow road users, such as motorists and pedestrians, to safely cross the railway track section 2.

The warning equipment 35 is configured for emitting a warning, if the local detection module 36 detects the presence of an approaching railway vehicle within a predetermined amount of time or distance from the level crossing 33, in particular if the railway vehicle is present in the railway track section 2.

According to embodiments, the warning equipment 35 comprises at least one element among a gate, a light signal and a bell.

The local detection module 36 is configured for emitting a second track signal S2 into the rails 6, 8 of the railway track section 2, so that the local detection module 36 is configured for detecting the presence of the railway vehicle on each position within the railway track section 2. For example, the local detection module 36 is connected via wires 38 to the rails 6, 8 respectively at each side of the level crossing 33 in the longitudinal direction.

The second track section signal S2 is distinct from the first track section signal S1, and preferably used only to manage safe operation of the warning system for that specific level crossing 33.

According to embodiments, the second track section signal S2 comprises at least one signal depending on the respective local protection device 22, such as an identifier.

According to embodiments, the second track section signal S2 includes a continuous frequency tone used to measure the track impedance between the level crossing 33 and the nearest train axle. As the train axles 18 approach the level crossing 33, the track impedance as detected by signal S2 decreases proportionally to the distance and speed of the train approaching the level crossing 33.

For example, the local detection module 36 is unable to detect the railway vehicle in at least one position of the railway track section 2 in absence of the first track circuit signal S1, if an electrical resistance between at least one of the rails 6, 8 and the corresponding wheel(s) 16 is higher than a resistance threshold depending for example on the second track circuit signal S2.

In particular, the first track circuit signal S1 allows breaking through the electrical resistance between the rails 6, 8 and the wheels 16, thanks to an electrical tension between the two rails 6, 8 induced by the signal S1, in particular if the second component C2 is included in the signal S1. This may not be the case, in at least one position of the section 2, in absence of the first track circuit signal S1, because the tension between the rails 6, 8 may be too low for breaking through the resistance.

According to some embodiments, the local detection module 36 is able to detect the railway vehicle within a predetermined maximum distance from the module 36 only, in particular in a part of the section 2 only. The predetermined maximum distance depends for example on the electrical resistance between the rails 6, 8 and the wheels 16.

According to embodiments, the local detection module 36 comprises a track crossing predictor configured for predicting a passage of a railway vehicle at the local protection device 22 based on impedance measurements of the rails 6, 8. For example, the local detection module 36 is configured for determining a complex impedance between the rails 6, 8.

According to embodiments, the local detection module 36 is configured for estimating a speed of the railway vehicle in the railway track section 2 in function of the complex impedance, in particular in function of the value and the rate of change of the complex impedance.

According to embodiments, the local detection module 36 is configured for estimating a distance of the railway vehicle to the local detection module 36 in function of the complex impedance, in particular in function of the value of the complex impedance compared with predetermined values corresponding to specific distances.

Examples of the operation of the local detection module 36 are described with reference to FIGS. 6 and 7.

Figure 6:
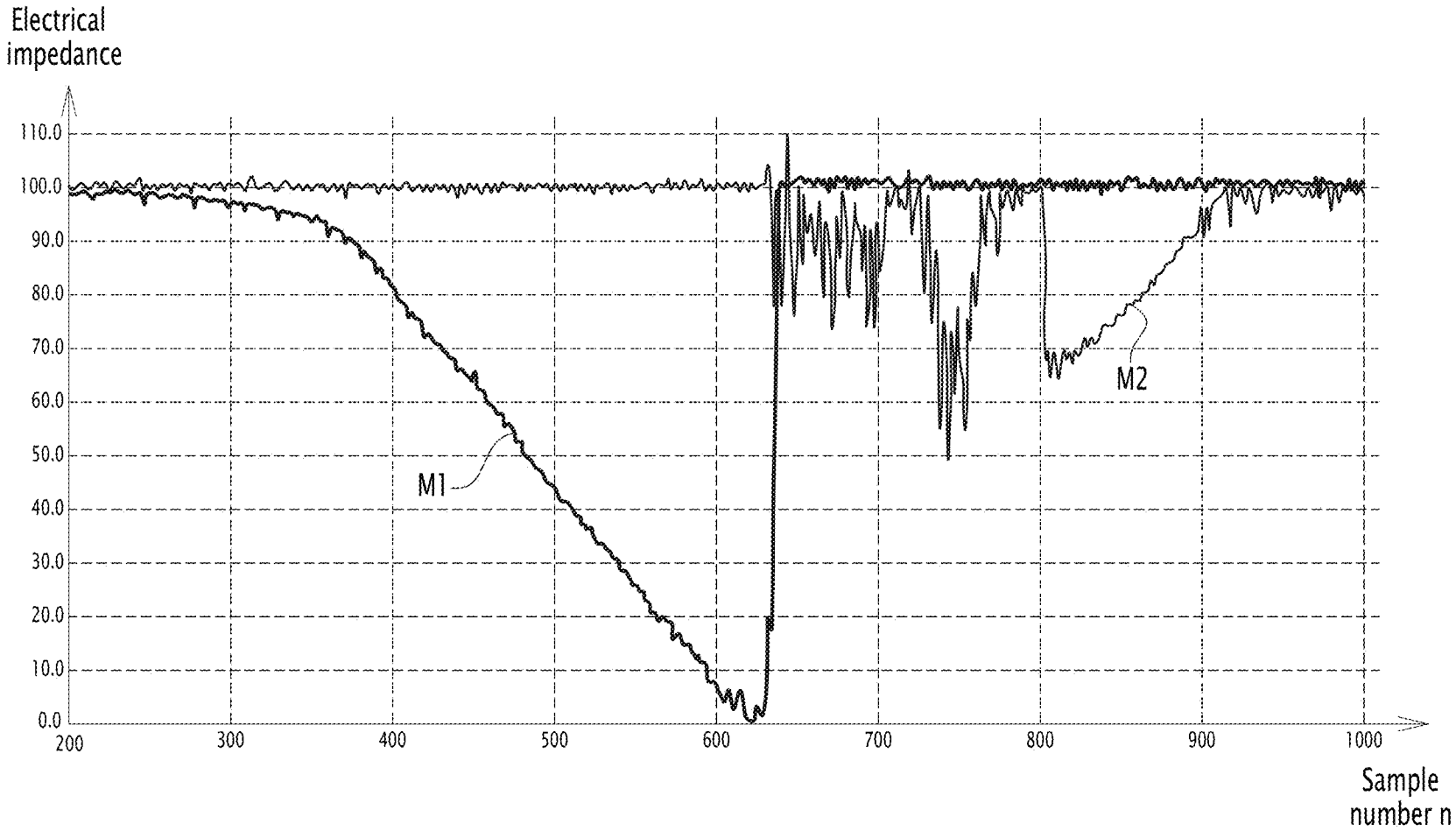
FIG. 6 is a schematic plot showing a first example of an electrical impedance of rails of the railway infrastructure of FIG. 1.
Figure 7:
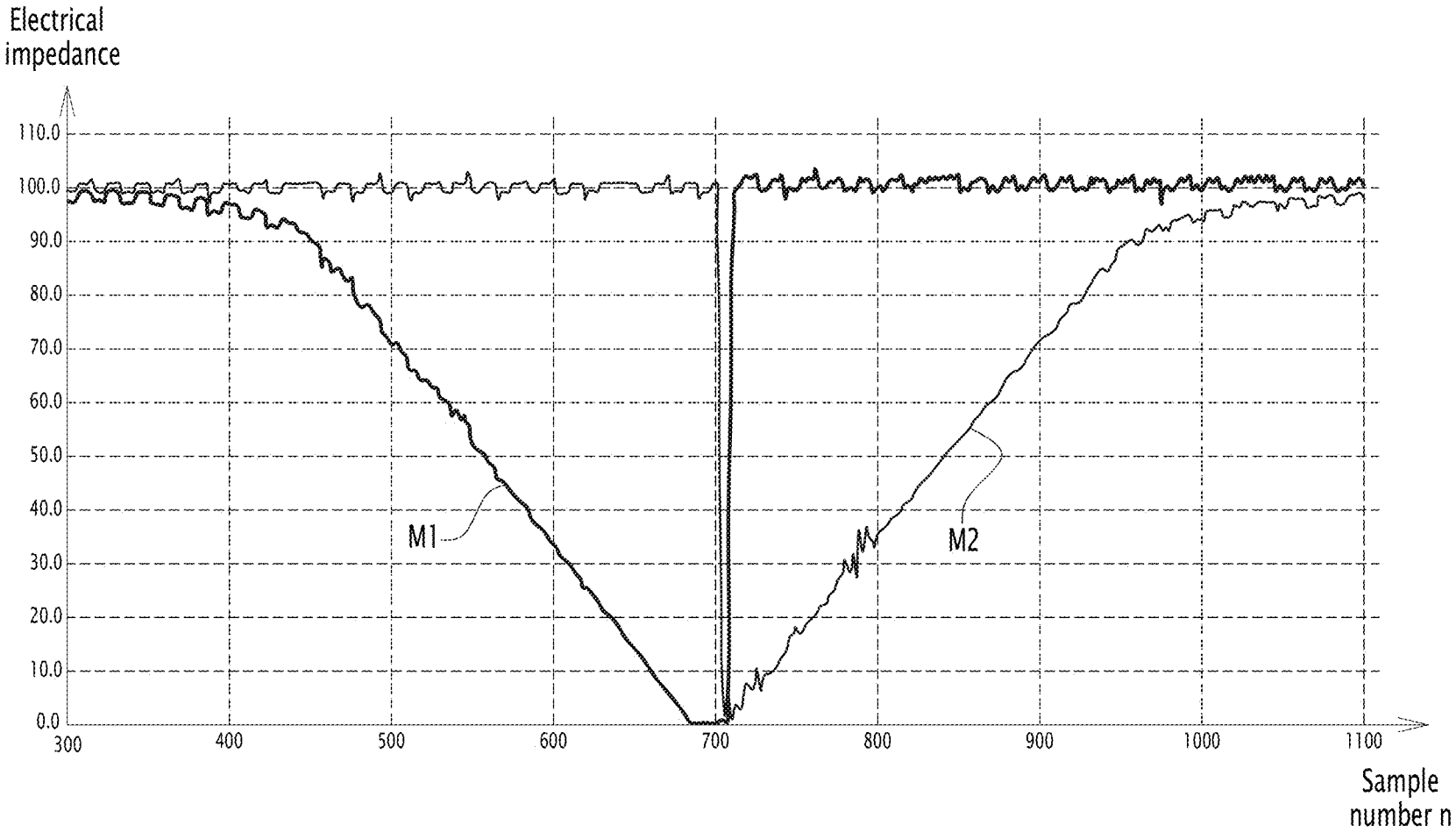
FIG. 7 is a schematic plot showing a second example of an electrical impedance of rails of the railway infrastructure of FIG. 1.

FIGS. 6 and 7 are schematic plots of examples of the electrical impedance M1, M2 measured respectively by one of the local detection modules 36. In FIGS. 6 and 7, examples of the electrical impedance over measurement samples n are shown. For example, four measurement samples n are taken per second. The Y-Axis indicates in particular a percentage of the railway track section 2 that is free of trains. For example, if Y=100, this means that the area on either side of the level crossing 33 that is being monitored, e.g. the section 2, is 100% free of trains. If Y=50, then there is a train 50% of the way up to the level crossing 33, for example at 1500 m if monitoring 3000 m on either side of the level crossing 33.

With reference to FIGS. 6 and 7, a first electrical impedance M1 corresponds to the electrical impedance of the rails 6, 8 measured by the local detection modules 36 between an electrical connection of the module 36 to the rails 6, 8 at a first side of the level crossing 33 and the axle 18 in the railway track section 2. A second electrical impedance M2 corresponds to the electrical impedance of the rails 6, 8 measured by the local detection modules 36 at a second side of the same level crossing 33, opposite to the first side.

In case of shunting via the axle 18 in the section 2, the electrical impedance decreases with a decreasing distance between the axle 18 and the level crossing 33, in particular when a railway vehicle approaches the level crossing 33. The electrical impedance is substantially zero if the axle is at the level crossing 33.

In the example of FIG. 6, the signal generator 24 does not inject the first track circuit signal S1 or provides a signal without the second component C2. The measured first electrical impedance M1 decreases from sample n=200 to sample n=630 corresponding to the axle 18 and thus the railway vehicle being positioned at the level crossing 33. The second electrical impedance M2 does not decrease or increase, which is corresponds to a failure of shunting of the second track section signal S2. The local detection modules 36 is unable to detect the railway vehicle on the basis of the measurement of impedance M2.

In the example of FIG. 7, the signal generator 24 injects the first track circuit signal S1, comprising the first and the second component C1, C2, into the section 2. In this case, the first and second measured first electrical impedance M1, M2 decrease to zero at n=700, which corresponds to a measurement sample indicating that the axle 18 is positioned at the level crossing 33. In particular, thanks to the first track circuit signal S1 injected by the signal generator 24, the local detection modules 36 is able to detect the railway vehicle in any position of the section 2, based on the first impedance M1, or based on the second impedance M2.

A method for detecting the presence of a railway vehicle is now described. The method is for example implemented by the railway detection system 4. The method comprises a generating step, a receiving step and a detecting step.

During the generating step, the signal generator 24 generates the first track circuit signal S1 and injects the first track circuit signal S1 into the railway track section 2 at the first end 10.

In particular, the signal generator 24 generates the first component C1 of the first track circuit signal S1, generates the second component C2 of the first track circuit signal S2 and adds the first and the second component C1, C2 so as to obtain the first track circuit signal S1.

During the receiving step, the track circuit receiver 26 receives the first track circuit signal S1 injected by the signal generator 24 into the railway track section.

During the detecting step, the track circuit detection device 28 determines that the railway track section 2 is clear of railway vehicles, in particular if the current value of the first track circuit signal S1 received by the track circuit receiver 26 is higher than the predetermined threshold.

Otherwise, the track circuit detection device 28 determines in particular that the railway track section 2 is occupied by a railway vehicle.

The railway detection system 4 according to the present disclosure presents many advantages.

The signal generator 24, placed preferably in a single housing, allows integrating two functions in a same generator. Indeed, the signal generator 24 allows detecting a railway vehicle in the section 2, and also to permanently enhance shunting for any device using track signals and which is placed in the section 2, such as the track circuit detection device 28, but also the or each local detection module 36.

Also, thanks to the first signal S1 injected by the signal generator 24, no additional shunt enhancing modules are needed for enhancing shunting of the second signal S2 of the local detection module 36.

What is claimed is:

1. A railway detection system for detecting the presence of a railway vehicle on a railway track section comprising at least two rails, the railway track section comprising a first end and a second end opposite to the first end in a longitudinal direction of the railway track section, the railway detection system comprising a track circuit system comprising:

a signal generator electrically coupled to the first end of the railway track section, the signal generator being configured for generating a first track circuit signal to be injected into the railway track section at the first end, wherein the signal generator is adapted to:

generate a first component of the first track circuit signal comprising at least one DC pulse;

generate a second component of the first track circuit signal, the second component comprises at least one element chosen from a constant DC signal and a constant frequency AC signal, add the first and the second component so as to obtain the first track circuit signal, a track circuit receiver connected to the second end of the railway track section and adapted to receive the first track circuit signal injected by the signal generator into the railway track section;

a track circuit detection device connected to the track circuit receiver, the track circuit detection device being configured for determining that the railway track section is clear of railway vehicles.

2. The railway detection system according to claim 1, wherein the track circuit detection device is configured for determining that the railway track section is clear of railway vehicles if a current value of the first track circuit signal received by the track circuit receiver is higher than a predetermined threshold.

3. The railway detection system according to claim 1, wherein the railway protection system further comprises at least one local protection device positioned in said railway track section between the first end and the second end, the at least one local protection device providing a safety related function depending on the presence of the railway vehicle in the railway track section, the at least one local protection device comprising a local detection module configured for emitting a second track signal into at least one of the rails of the railway track section, so that the local detection module is configured for detecting the presence of the railway vehicle on each position within the railway track section.

4. The railway detection system according to claim 3, wherein the local protection device comprises a level crossing.

5. The railway detection system according to claim 3, wherein the at least one local protection device comprises warning equipment configured to emit a warning if the local detection module detects the presence of the railway vehicle in the railway track section.

6. The railway detection system according to claim 5, wherein the warning equipment comprises at least one element among a gate, a light signal and a bell.

7. The railway detection system according to claim 3, wherein the local detection module is unable to detect the railway vehicle in at least one position of the railway track section in absence of the first track circuit signal, if an electrical resistance between at least one of the at least two rails and at least one wheel of the railway vehicle is higher than a resistance threshold.

8. The railway detection system according to claim 3, wherein the local detection module is configured for determining a complex impedance between the at least two rails.

9. The railway detection system according to claim 8, wherein the local detection module is configured for estimating a speed of the railway vehicle in the railway track section in function of the complex impedance and/or for estimating a distance of the railway vehicle to the local detection module in function of the complex impedance.

10. The railway detection system according to claim 1, wherein the constant DC signal has a voltage of at least 3 volts.

11. The railway detection system according to claim 1, wherein the constant frequency AC signal has a frequency range comprised between 5 Hz and 40 Hz.

12. The railway detection system according to claim 1, wherein the first component comprises furthermore a data signal depending on the railway track section.

13. The railway detection system according to claim 1, wherein the signal generator is configured for generating the second component of the first track circuit signal only if the railway vehicle is present in the railway track section.

14. The railway detection system according to claim 1, wherein the track circuit detection device is configured for transmitting a first detection signal relative to the presence of the railway vehicle in the railway track section to the signal generator, the signal generator being configured for generating the second component of the first track circuit signal only upon reception of the first detection signal.

15. The railway detection system according to claim 1, wherein the track circuit detection device is configured for transmitting a second detection signal relative to the presence of the railway vehicle in the railway track section to a remote train control system, if a current value of the first track circuit signal received by the track circuit receiver is lower than a second predetermined threshold.

16. The railway detection system according to claim 1, wherein the railway track section is electrically insulated by insulating joints from neighboring sections of the rails.

17. The railway detection system according to claim 1, wherein the signal generator is a digital signal generator.

18. The railway detection system according to claim 1, wherein the track circuit detection device comprises an electrical resistance estimation module configured for comparing a current value of the first track circuit signal emitted by the signal generator with the current value of the first track circuit signal received by the track circuit receiver, so as to estimate an electrical resistance between at least one rail of said at least two rails and at least one wheel of the railway vehicle.

19. The railway infrastructure comprising a railway track section comprising at least two rails, the railway track section comprising a first end and a second end opposite to the first end in a longitudinal direction of the railway track section, wherein the railway infrastructure comprises at least one railway detection system according to claim 1.

20. A method for detecting the presence of a railway vehicle on a railway track section comprising at least two rails, the railway track section comprising a first end and a second end opposite to the first end in a longitudinal direction of the railway track section, the method comprising:

generating, by a signal generator electrically coupled to the first end of the railway track section, a first track circuit signal to be injected into the railway track section at the first end, the generating comprising:

generating a first component of the first track circuit signal comprising at least one DC pulse;

generating a second component of the first track circuit signal, the second component comprises at least one element chosen from a constant DC signal and a constant frequency AC signal, adding the first and the second component so as to obtain the first track circuit signal, receiving, by a track circuit receiver connected to the second end of the railway track section, the first track circuit signal injected by the signal generator into the railway track section;

detecting, by a track circuit detection device connected to the track circuit receiver, that the railway track section is clear of railway vehicles.

* * * * *